US007398961B2

(12) United States Patent
Froese

(10) Patent No.: US 7,398,961 B2
(45) Date of Patent: Jul. 15, 2008

(54) SYSTEM FOR MOUNTING A HOLLOW POST ABOUT A PIPE

(75) Inventor: Joseph S. Froese, Winnipeg (CA)

(73) Assignee: Straight'n Level Fencing Solutions Inc., Brunkild, CA (US)

( * ) Notice: Subject to any disclaimer, the term of this patent is extended or adjusted under 35 U.S.C. 154(b) by 0 days.

(21) Appl. No.: 11/370,173

(22) Filed: Mar. 8, 2006

(65) Prior Publication Data

US 2007/0210294 A1 Sep. 13, 2007

(51) Int. Cl.
*E04C 3/30* (2006.01)
*E04H 17/22* (2006.01)

(52) U.S. Cl. ..... 256/65.14; 256/DIG. 5; 52/301; 52/736.3

(58) Field of Classification Search ..... 256/19, 256/65.14, DIG. 5; 52/170, 223.13, 296, 52/297, 301, 721.4, 736.1, 736.3
See application file for complete search history.

(56) References Cited

U.S. PATENT DOCUMENTS

| | | | | | |
|---|---|---|---|---|---|
| 950,806 | A * | 3/1910 | Richardson | 52/301 |
| 4,912,901 | A * | 4/1990 | Jerry | 52/301 |
| 5,312,089 | A * | 5/1994 | Venegas, Jr. | 256/65.12 |
| 5,457,929 | A * | 10/1995 | Kim | 52/721.4 |
| 5,722,205 | A * | 3/1998 | Gannaway | 52/155 |
| 5,901,525 | A * | 5/1999 | Doeringer et al. | 52/736.4 |
| 6,058,675 | A * | 5/2000 | MacDonald | 52/736.1 |
| 6,213,452 | B1 | 4/2001 | Pettit et al. | 256/59 |
| 6,467,756 | B1 * | 10/2002 | Elsasser | 256/65.14 |
| 6,523,808 | B1 | 2/2003 | Lehmann | 256/65.14 |
| 6,851,247 | B1 * | 2/2005 | Turner et al. | 52/736.3 |
| 6,948,283 | B2 | 9/2005 | Burkart et al. | |
| 2003/0233793 | A1 * | 12/2003 | Burkart et al. | 52/165 |
| 2006/0022188 | A1 * | 2/2006 | Collins, IV | 256/65.14 |

* cited by examiner

*Primary Examiner*—Daniel P. Stodola
*Assistant Examiner*—Joshua T Kennedy
(74) *Attorney, Agent, or Firm*—Ryan W. Dupuis; Adrian D Battison; Michael R. Williams

(57) ABSTRACT

A system for mounting a hollow post about a pipe features upper and lower mounting devices vertically spaced along the pipe. The lower mounting device is slidable along the pipe to define a height at which the hollow post sits atop a base of the lower mounting device. The lower mounting device is mountable on the pipe to allow control over the post height with minimal ground surface preparation. The upper mounting device features two members that are engagable in a number of different relative positions to allow relative positioning of the pipe and post, to each of which a respective one of the two members is engaged. In one embodiment, engagement of the members to separate ones of the post and pipe allows adjustment of the post's position relative to the pipe after installation without removal of the post for access to the upper mounting device.

8 Claims, 8 Drawing Sheets

SYSTEM FOR MOUNTING A HOLLOW POST ABOUT A PIPE

This invention relates to a system for mounting a hollow post about a pipe and more particularly relates to a system having upper and lower mounting devices supported on the pipe at spaced heights therealong to engage the hollow post.

BACKGROUND OF THE INVENTION

Plastic or vinyl rail assemblies, for example for use in fencing and decking, are gaining popularity due to their durability and pleasant appearance. Unlike wood used in conventional fencing or decking rail assemblies, the plastic or vinyl components do not require post-sale painting and weatherproofing and will not rot over time. Rail assemblies feature horizontal rails supported on and extending between vertical posts spaced apart along a straight line. Plastic or vinyl posts are usually manufactured to be hollow, and as such are usually fitted over and supported about rigid pipes that provide the necessary strength to support the final structure. The rigid pipe may be supported by driving a lower end thereof a distance into the ground or by anchoring it to some kind of foundation or support surface that must be provided on/in/above the ground. Different devices have been developed for positioning the hollow post about the pipe for each of these situations.

U.S. Pat. No. 6,213,452 discloses a base plate adapted to engage both the hollow vinyl post and the interior support pipe to support them to extend upward from a horizontal support surface. Installation of a series of posts to create a substantially horizontal rail assembly may prove difficult in situations where the ground surface features irregularities that deviate from the horizontal, as the support surfaces for some base plates may have to be built up from or recessed into the ground to support neighbouring posts at a common elevation. Building up of a base plate may require additional materials to do so and recessing a base plate may require accurate earth removal to form a horizontal surface at a specific depth. Adjustment of relative tilt between longitudinal axes of the post and pipe is achieved through adjustment of screws extending radially outward from the pipe near an upper end thereof, such that each screw engages an inner surface of the hollow post at a desired distance from the pipe. Allowing misalignment of the axes of the post and pipe allows the post to extend vertically about the pipe even if the pipe is not perfectly vertical. Access to the screws likely requires either removal of the hollow post from about the pipe or formation of openings in the hollow post through which they can be accessed.

U.S. Pat. No. 6,523,808 discloses a fixture for positioning the hollow post concentrically about the pipe regardless of how the pipe is anchored at its lower end. The fixture features an inner cylinder which is slid over the pipe and fastened thereto and a larger outer cylinder that engages inner surfaces of the hollow post to retain it at a fixed distance from the pipe in all directions. Two fixtures are used to position the post near the top and bottom ends thereof. The post is lowered over the fixtures until a bottom end thereof engages a base surface for support thereon. For the reasons provided in the preceding paragrapsh, providing a series of equally elevated horizontal support surfaces over a distance may require substantial effort, materials and/or time.

Mounting devices similar to the fixture described above have been developed in which the inner cylinder is replaced with an oblong collar having an inner width substantially equal to an outer diameter of the pipe so that the axes of the pipe and mounting device can be misaligned by movement of the pipe within the collar before fastening of the two. This allows relative positioning of the hollow post and pipe such that the post can be disposed in a vertical orientation even if the pipe about which it is disposed is not perfectly vertical. It should be appreciated that after fastening, further adjustment of the mounting device requires unfastening it from the pipe and moving it relative thereto for refastening. Such further adjustment therefore would require access to the mounting device, for example by either at least partial removal of the post from about the pipe or the formation of openings in the post to access the mounting device fastener therein.

SUMMARY OF THE INVENTION

According to a first aspect of the invention there is provided a system for mounting a hollow post about a pipe, the system comprising:

a lower mounting device for supporting the hollow post about the pipe, the lower mounting device comprising:

a base having an outer dimension greater than an inner dimension of the hollow post so that a lower end of the hollow post can rest on the base;

a pipe-receiving opening defined in the base through which the pipe is passable; and a post-engaging mechanism adapted to engage the hollow post upon receipt thereof onto the base to retain the hollow post thereon;

and an upper mounting device for positioning the hollow post about the pipe at a distance upward along the pipe from the lower mounting device;

the lower mounting device being positionable along the pipe by relative movement of the pipe through the pipe-receiving opening to define a height at which the hollow post is supported on the base.

The movement of the lower mounting device along the pipe allows an installer to quickly and easily adjust the elevation of the base on which the hollow post is to be mounted, for example to ensure rails later connected between the posts will extend horizontally to give a neat, pleasant appearance regardless of fluctuations in the ground surface. In this example, once a lower mounting device has been fastened to a first pipe at a desired elevation, the lower mounting device of a neighbouring post can be aligned with that of the first using a laser level, string or other straight line and then fastened in place. Supporting the base on the pipe rather than the ground reduces the time, effort and materials needed to provide alignment of the support surfaces of neighbouring posts.

Preferably the lower mounting device further comprises an earth-engaging mechanism extending from the base for stabilization thereof. Preferably the earth-engaging mechanism comprises at least one earth piercing element extending downward from the base. Preferably the at least one earth-piercing element comprises a plurality of piercing elements spaced about the pipe receiving opening in the base. The piercing elements allow an additional use of the lower mounting device as a stable position marker for installing the pipe. The piercing elements are driven into the ground to hold the lower mounting device in place to mark a desired post position, after which the pipe can be driven into the ground through the pipe-receiving opening. Depending on where along the pipe the lower mounting device is later fastened to define the base height of the post, the piercing elements may also engage the ground in this fastened position to further stabilize the base.

Preferably the post-engaging mechanism of the lower mounting device comprises at least one protrusion extending upward from the base for contact with inner surfaces of the hollow post upon receipt thereof onto the base.

Preferably the at least one protrusion comprises a closed wall extending about the pipe receiving opening in the base.

Preferably the closed wall is substantially annular.

Preferably the lower mounting device further comprises a second post-engaging mechanism for engagement with a larger post. Two post-engaging mechanisms on a single lower mounting device allows use of the device with posts of two different sizes to eliminate the need to produce separate devices for each size of post.

Preferably the lower mounting device further comprises a pipe collar extending upward from the base with an opening defined by the pipe collar in communication with the pipe-receiving opening in the base. Preferably the pipe collar extends upward substantially passed the pipe engagement mechanism. Extending significantly upward from the base, the collar provides an attachment point for fastening to the pipe which is open for access in radial directions.

According to a second aspect of the invention there is provided a system for mounting a hollow post about a pipe, the system comprising:

a lower mounting device for positioning the hollow post about the pipe; and an upper mounting device for positioning the hollow post about the pipe at a distance upward along the pipe from the lower mounting device, the upper mounting device comprising:

a first member adapted to engage an exterior of the pipe; and a second member being adapted to engage an interior of the hollow post;

the first and second members being movable relative to one another between an unengaged state and any of a plurality of engaged states; and the first and second members interlocking in each of the engaged states to secure the first member in a different respective position relative to the second member in a plane perpendicular to the pipe.

In one embodiment, engaged to separate ones of the pipe and hollow post, the two members of the upper mounting device are movable to their unengaged state through relative motion between the pipe and the hollow post supported thereabout. As a result, the upper mounting device can be adjusted to reposition the hollow post about the pipe upward from the lower mounting device without having to remove the post or otherwise gain access to the upper mounting device.

Preferably the first member of the upper mounting device is disposed below the second member thereof along the pipe in the unengaged state.

Preferably the second member of the upper mounting device is supported on the first member thereof in each of the engaged states.

Preferably the positions of the first member of the upper mounting device relative to the second member thereof in the engaged states are linearly disposed along the plane perpendicular to the pipe.

Preferably relative rotation between the first and second members of the upper mounting device is prevented by the interlocking in each of the engaged states.

Preferably the second member of the upper mounting device comprises an opening being greater in size than an outer dimension of the first member and the first member is received at least partly within the opening of the second member in each of the engaged states.

Preferably the first member of the upper mounting device has teeth extending outward therefrom toward the second member and the second member has teeth extending into the opening toward the first member, the teeth of the inner member overlapping with the teeth of the outer member with the first and second members in the engaged state.

Preferably the upper mounting device further comprises a third member engaged to the second member, the third member being adapted to engage an interior of a larger hollow post.

Preferably the third member of the upper mounting device is engaged to the second member to be movable threwith between the unengaged state and any of the engaged states.

BRIEF DESCRIPTION OF THE DRAWINGS

In the accompanying drawings, which illustrate an exemplary embodiment of the present invention.

DETAILED DESCRIPTION

Figure 1:
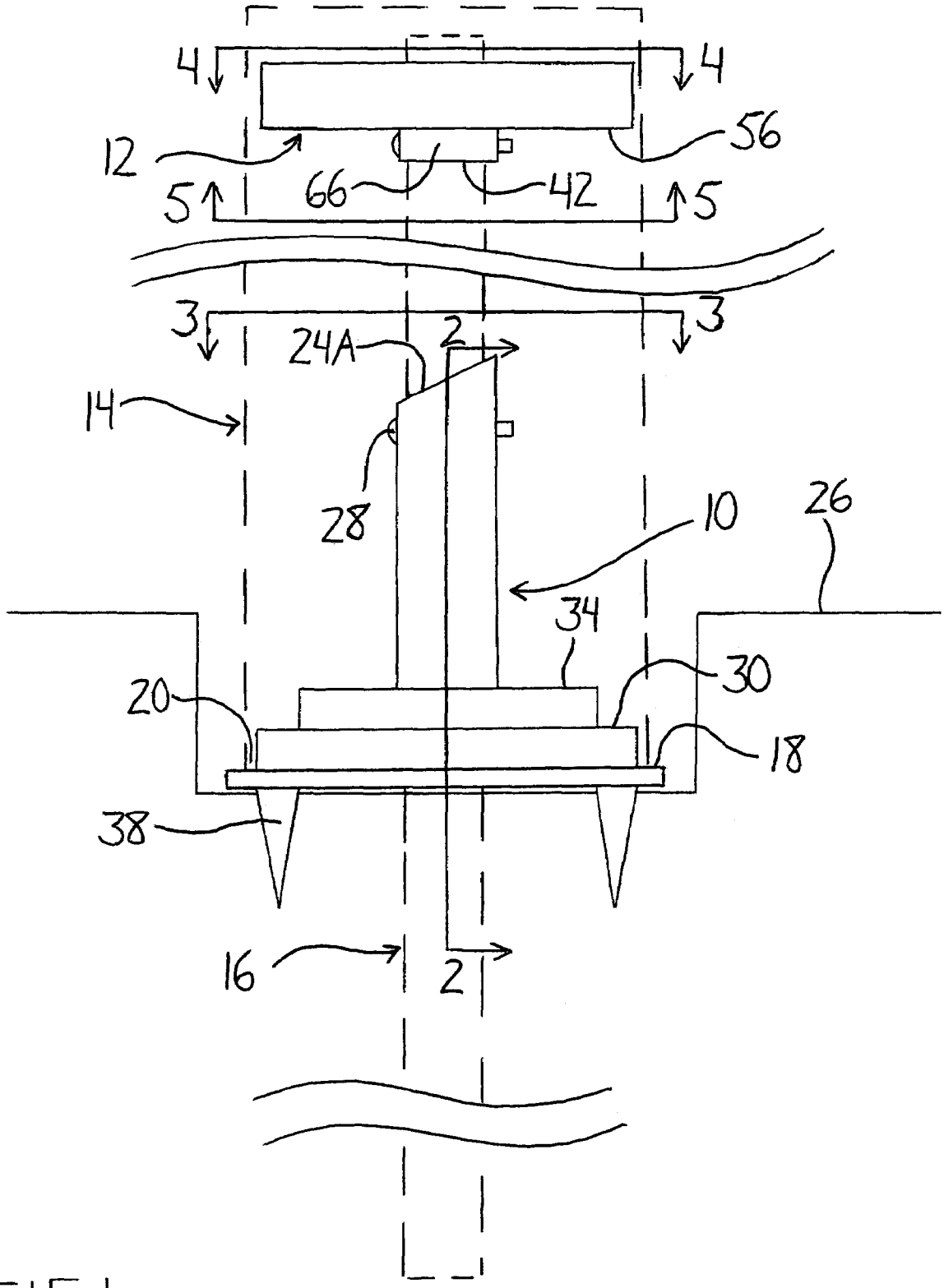
FIG. 1 is a side elevational view of a system for mounting a hollow post about a pipe, the system having upper and lower mounting devices and the ground being cut away to aid in illustration of the lower mounting device.
Figure 2:
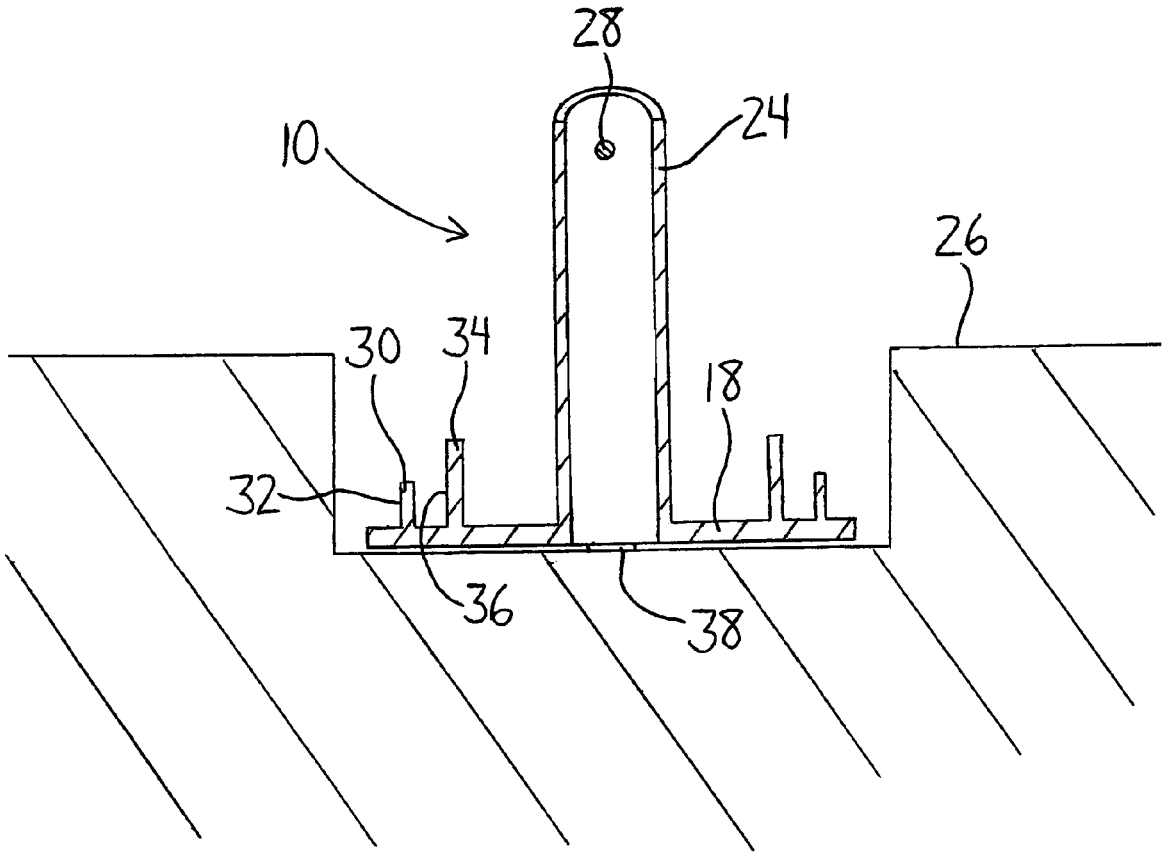
FIG. 2 is a cross sectional view of the lower mounting device as taken along line 2-2 of FIG. 1.
Figure 3:
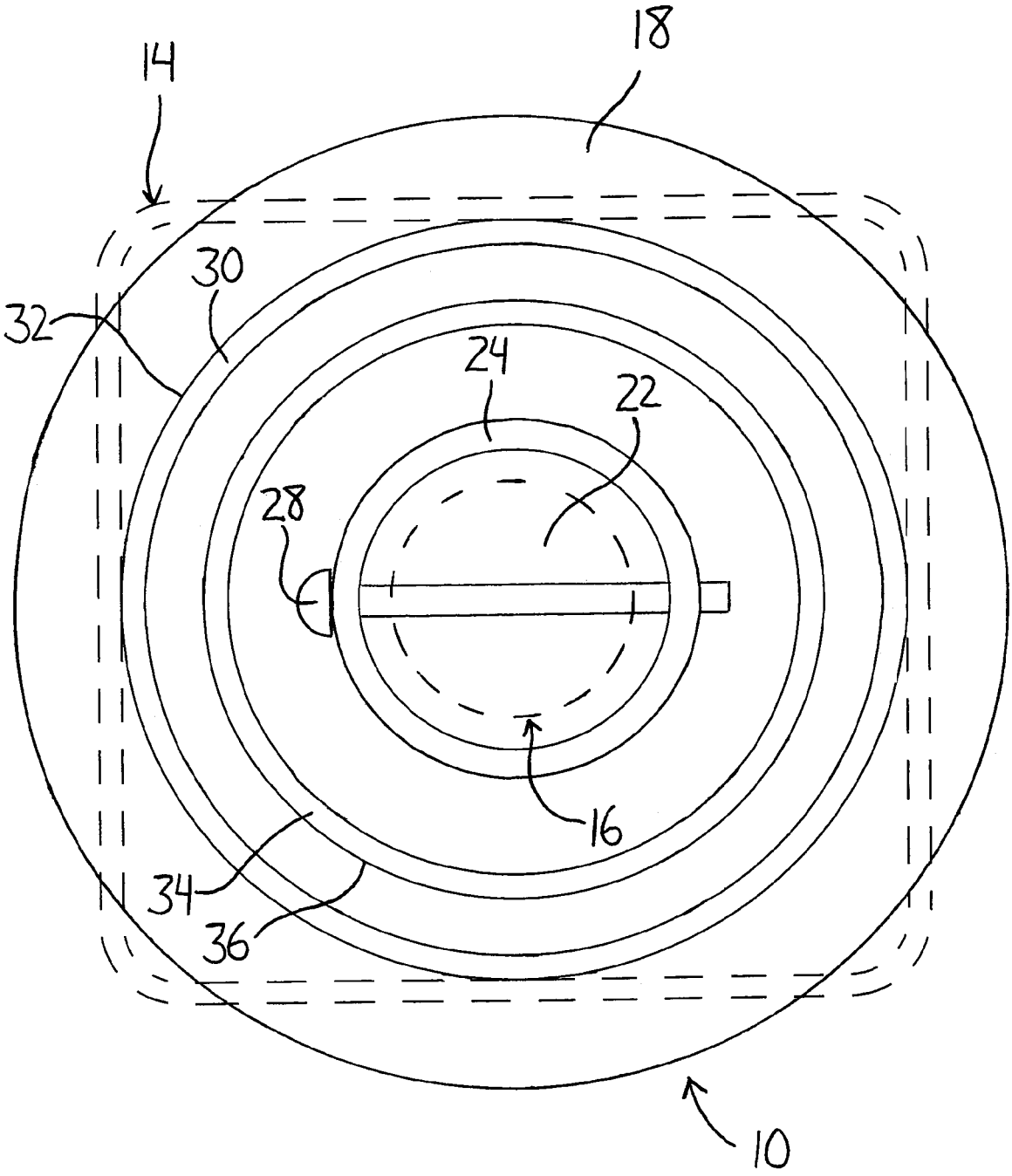
FIG. 3 is a top plan view of the lower mounting device as taken along line 3-3 of FIG. 1.

As shown in FIG. 1, a system for mounting a hollow post about an upward extending pipe features a lower mounting device 10 and an upper mounting device 12. The lower mounting device 10 defines a base on which the hollow post, represented by broken lines generally indicated at 14, rests when lowered over the pipe, represented by broken lines generally indicated at 16. The lower mounting device 10 is movable up and down along the pipe 16 before being fastened thereto such that an installer can adjust the height at which the hollow post 14 is disposed. The upper mounting device 12 allows adjustment of an angle between longitudinal axes of the pipe 16 and hollow post 14 to allow vertical alignment of the post even if the pipe 16 is not installed in perfect vertical orientation. The upper mounting device of the illustrated embodiment allows adjustment of this relative tilt after installation of the hollow post without requiring removal thereof from about the pipe to re-expose the upper mounting device 12 for access thereto.

The lower mounting device 10 features a flat base plate 18 having an outer dimension greater than that of the hollow post 14, such that a lower end 20 of the post can sit upon the base plate 18. A pipe-receiving hole 22 is provided centrally in the base plate 18 to allow the pipe 16 to be passable through the lower mounting device 10. A pipe collar 24 extends perpendicularly upward from the base plate 18 from a central position about the pipe-receiving hole 22. The opening defined by the hollow cylindrical pipe collar 24 is in communication with the pipe receiving opening 22 such that, when passed through the lower mounting device 10, the pipe 16 is partially housed within the pipe collar 24. An inner diameter of the pipe collar 24 is substantially equal in size to an outer diameter of the pipe 16 such that the collar fits substantially concentrically thereabout.

In the figures, the pipe 16 is shown as being supported by having been driven into the earth to a depth beneath the ground surface 26. This method of anchoring a substantially vertical pipe for use in construction of a fence or other rail structure is well known to those of skill in the art. For use on a pipe installed in this manner, the lower mounting device 10 can be slid downward over the pipe 16 from an upper end thereof after being driven into the ground, or alternatively, the lower mounting device 10 can be pre-positioned on the ground to mark the desired position of the pipe 16 which can then be driven into the earth through the collar 24 and pipe receiving opening 22. Either way, the result is that the lower mounting device is disposed about the pipe 16 near the ground surface 26. An upper end 24A of the pipe collar 24 is cut at an angle in order to ease insertion of the pipe into the collar 24 from above when using the lower mounting device 10 as a position marker. The angled end 24A eliminates the need for perfect alignment of the pipe with the collar to initially feed the pipe into the mounting device in preparation for driving it into the ground.

With the lower mounting device being slidable along the pipe 16, it can be moved up and down therealong to dispose the base plate 18 at a height corresponding to a desired elevation of the bottom end 20 of the hollow post 14, at which time the device is fastened to the pipe 16. The result of this relative movement between the two components is the elimination of dependence of the hollow post height on the ground surface 26. The lower mounting device 10 may be mounted to position the base plate 18 at, above or below ground surface 26. In the figures, the base plate 18 has been disposed below ground surface 26 by digging out earth around the pipe 16 to a depth of a couple of inches and fastening the device 10 to the pipe 16 with a screw 28 passed through the collar 24 and pipe 16. Disposed below the ground surface 26, the lower end 20 of the hollow post 14 is hidden from sight while the base plate 18 defines a flat support surface for the hollow post regardless of irregularities in the recess dug into the earth.

The adjustability of the height at which the hollow post 14 sits simplifies installation of a horizontal rail structure in areas where there are irregularities or deviations from the horizontal in the ground surface 26. The heights of neighbouring posts, for example during installation of a fence, can be determined and matched before the post is even placed over the pipe 16 by using a straight line or laser level to position the lower mounting devices of the neighbouring posts at the same elevation, i.e. in a common horizontal plane. This will ensure that rails installed to extend between the posts will have a visually appealing horizontal orientation that can be provided over the full length of the fence, regardless of ground contours. Using the positionability of the lower mounting device 10 along the pipe 16 to define the level at which the base plate 18 is supported facilitates quick and easy adjustment of post heights in, for example, fence construction.

An outer annular wall 30 extends upward from the base plate 18 concentrically about the pipe-receiving opening 22 and pipe collar 24 to act as a post-engaging mechanism for positioning the hollow post 14 about the pipe 16. The outer annular wall 30 is sized such that an outer surface thereof frictionally engages interior wall surfaces of the rectangular hollow post 14 when its lower end 20 is lowered onto the base plate 18. A similar inner annular wall 34 having an outer surface 36 is provided concentrically between the pipe collar 24 and the outer annular wall 30. The inner annular wall 34 is provided to act as another post-engaging mechanism for engaging a smaller hollow post. In this embodiment, the post-engaging mechanism defined by the outer annular wall 30 is sized to engage a hollow post having outer dimensions of five inches square, while the other post-engaging mechanism defined by the inner annular wall 34 is sized to engage a hollow post having outer dimensions of four inches square. These sizes were chosen based on dimensions of hollow posts commonly used in fencing applications. Having the two post-engaging mechanisms allows use of the same lower mounting device 10 for constructions using either of these two common post sizes. The pipe collar 24 extends a significant distance upward from the post-engaging annular walls 30, 34 to provide an area that is not blocked for access thereto in a radial direction. This provides room to facilitate easy fastening of the mounting device 10 to the pipe, for example sufficient room to easily accommodate an electric screwdriver for attachment of the collar 24 and the pipe 16 by the screw 28. Even if the base plate 18 is disposed a few inches below the ground surface 26, the pipe collar 24 extends sufficiently to provide an easily accessible anchoring point above the surface 26.

The lower mounting device 10 also features an earth-engaging mechanism in the form of earth-piercing spikes 38 extending downward from the base plate 18 at points radially outward from the pipe-receiving opening 22. The figures show two spikes 38 diametrically opposed on the base plate 18, but it should be appreciated that additional spikes may be included so long as they are spaced radially outward from the pipe-receiving opening so as not to interfere with passage of the pipe 16 therethrough. When using lower mounting devices as pipe position markers during installation of pipes, the spikes 38 can be driven into the ground to ensure that the devices remain in place until the pipes have been anchored in their respective positions in the pipe-receiving openings of the devices. Furthermore, the spikes 38 may extend into the ground to further stabilize a lower mounting device 10 fastened to its respective pipe 16 to resists unwanted movement of the base plate 18 on which the hollow post 14 sits.

The upper mounting device 12 is disposed on the pipe 16 a distance upward from the lower mounting device 10 in order to engage the hollow post 14 closer to an upper end 40 thereof and hold it in a certain position about the pipe 16. It is desirable to allow adjustment of such an upper mounting device so as to be able to change this position of the post 14 relative to the pipe 16 at the upper end 40. It should be appreciated that the pipe 16 may not have been installed so as to extend in a completely vertical manner, but that supporting the post 14 about the pipe 16 with a relative degree of tilt between them may allow the post 14 to be supported in a vertical manner without having to first reorient the pipe 16. After installation of the upper mounting device 12 and the hollow post 14 around the pipe 16, if it is found that further adjustment is necessary as the hollow post 14 is not quite vertical, the upper mounting device 12 of the illustrated embodiment allows such adjustment without having to substantially remove the hollow post 14 to regain access to the device 12.

Figure 4:
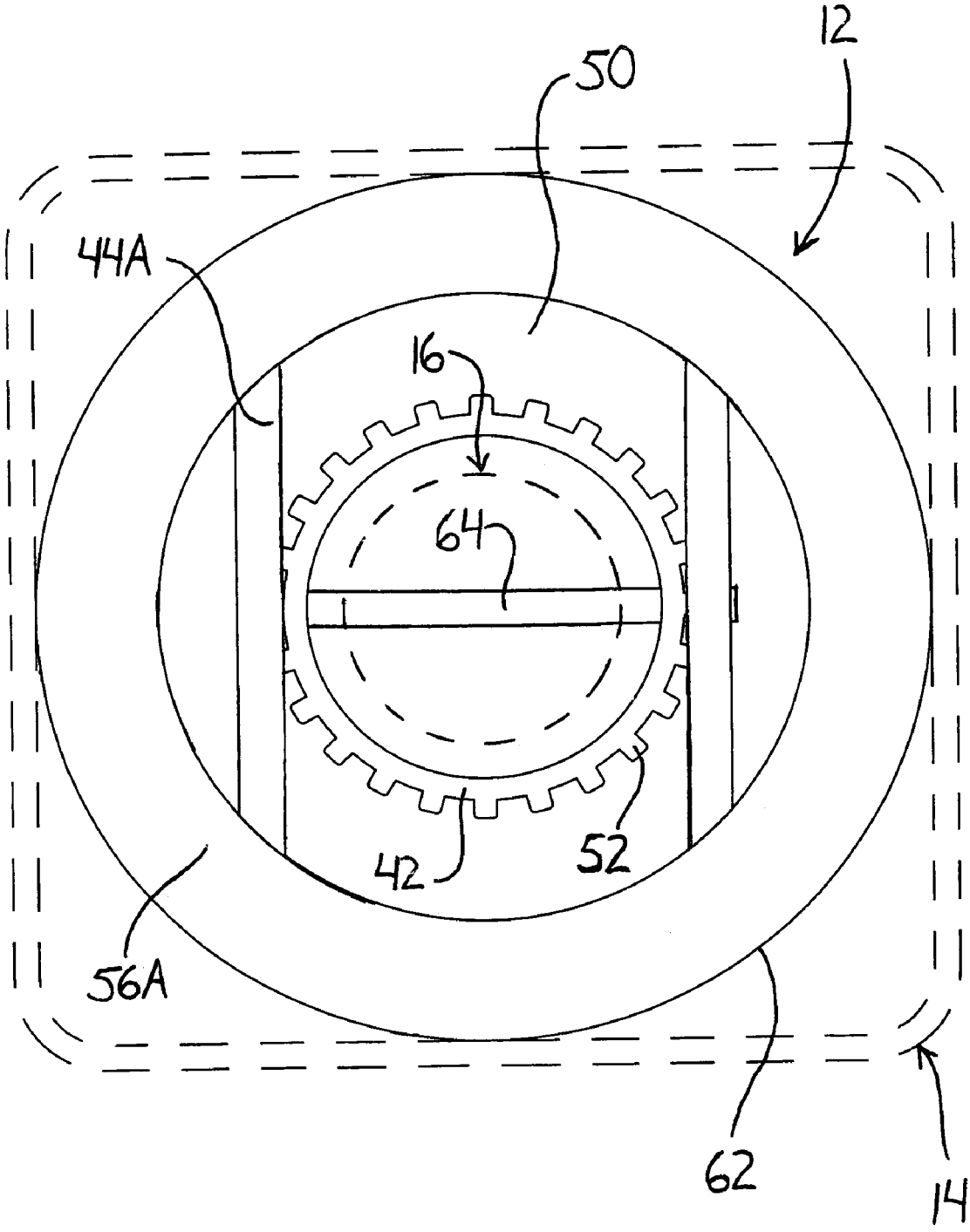
FIG. 4 is a top plan view of the upper mounting device as taken along line 4-4 of FIG. 1 with rings of the upper mounting device in a first engaged state.
Figure 5:
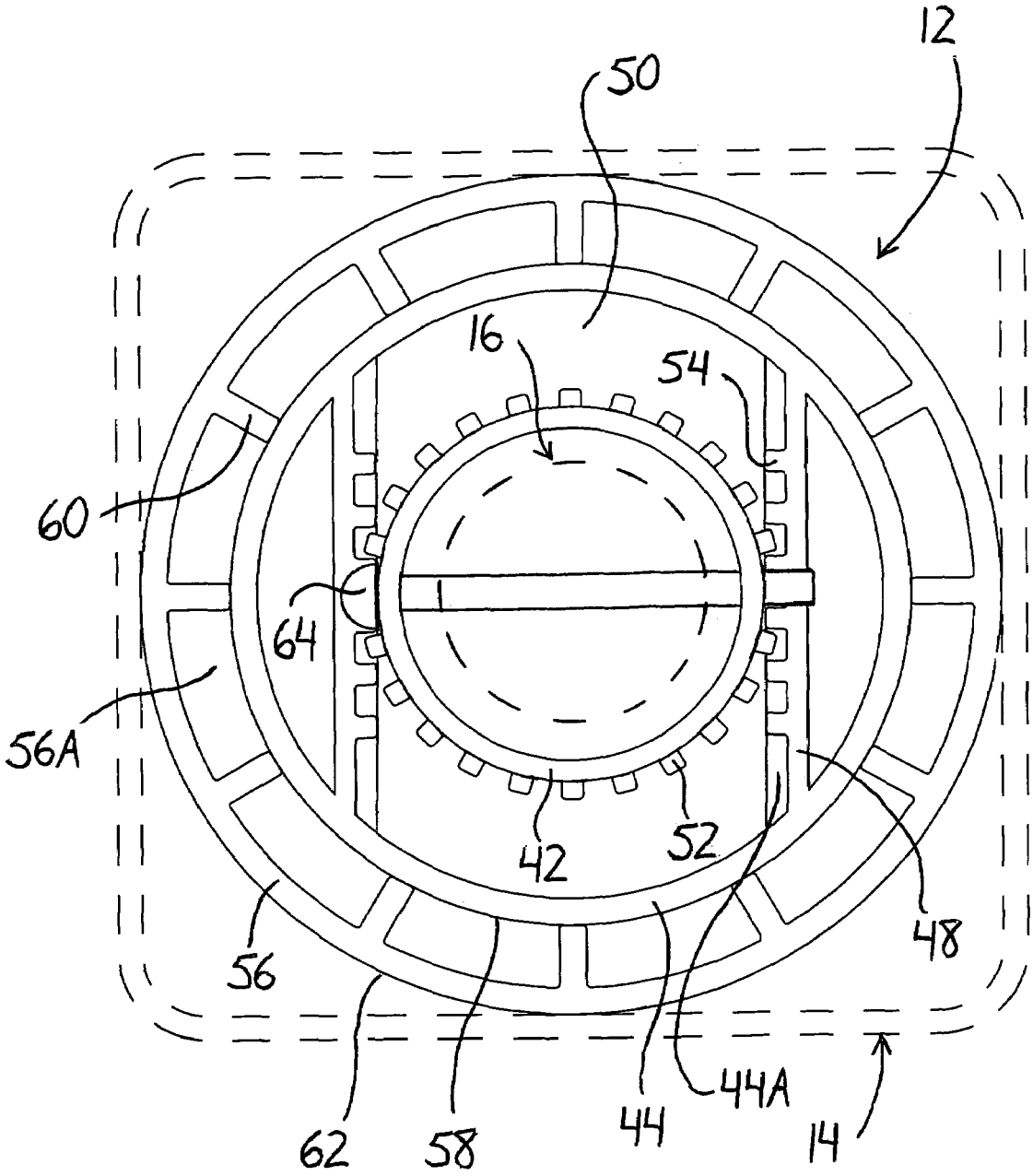
FIG. 5 is a bottom plan view of the upper mounting device as taken along line 5-5 of FIG. 1 with the rings of the upper mounting device in the first engaged state of FIG. 4.

The upper mounting device features a first ring 42 that can fit within a separate second ring 44 in a plurality of different engaged positions relative to thereto. The second ring 44 has two parallel chord elements 48 disposed symmetrically about an inner diameter thereof. A central opening 50 spanning the area between the chord elements 48 inside the second ring 44 is slightly wider, but substantially longer, than a diameter of the first ring 42. Teeth 52 spaced circumferentially around and extending radially outward from the first ring 42 engage with teeth 54 extending perpendicularly from the chord elements 48 into the central opening 50 defined partly thereby. This engagement of the teeth prevents relative motion between the first and second rings 42, 44 in a plane in which they lie when the first ring 42 is received in the central opening 50 of the second ring 44. It should be appreciated that as separate pieces, the first and second rings can be moved relative to one another without limitation upon removal of the first ring 42 from within the second ring 44 to an unengaged state. An outermost ring 56 is frictionally engaged to an outer surface 58 of the second ring 44 in a concentric manner by circumferentially spaced ribs 60 of equal length, each extending radially inward from the outermost ring 56. An outer surface 62 of the outermost ring 56 frictionally engages interior walls of the hollow post 14 so as to position them relative to the pipe 16, which is passed through the first ring 42. FIGS. 4 and 5 show the first and second rings 42, 44 in one engaged state in which the first and second rings are held concentric to one another such that the pipe 16 and hollow post 14 are concentrically positioned. This state would be suitable for use in the case where the pipe 16 is disposed vertically, making coaxial alignment of the post 14 to the pipe desirable.

Figure 6:
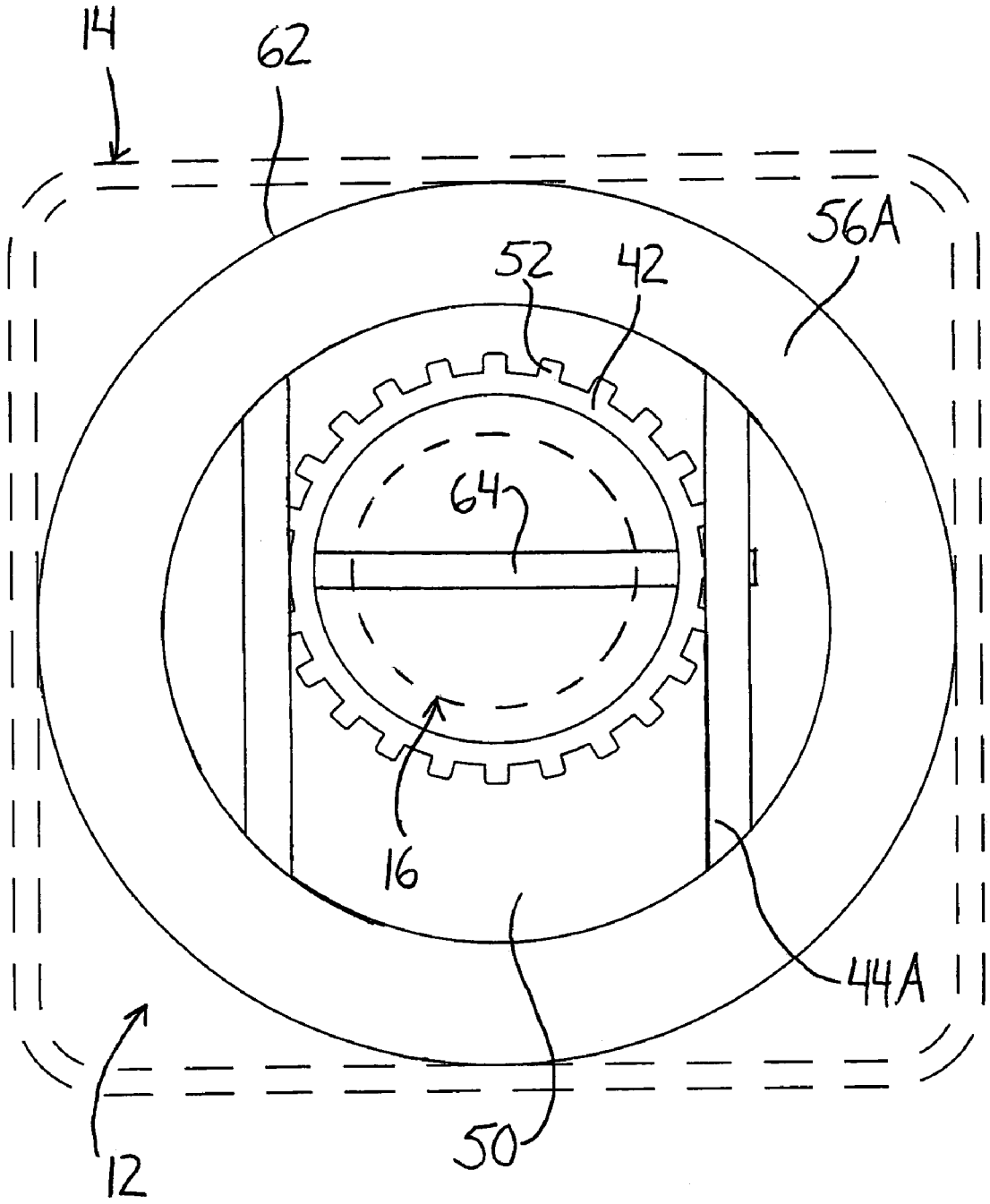
FIG. 6 is a top plan view of the upper mounting device of FIG. 1 with the rings of the upper mounting device in a second engaged state.
Figure 7:
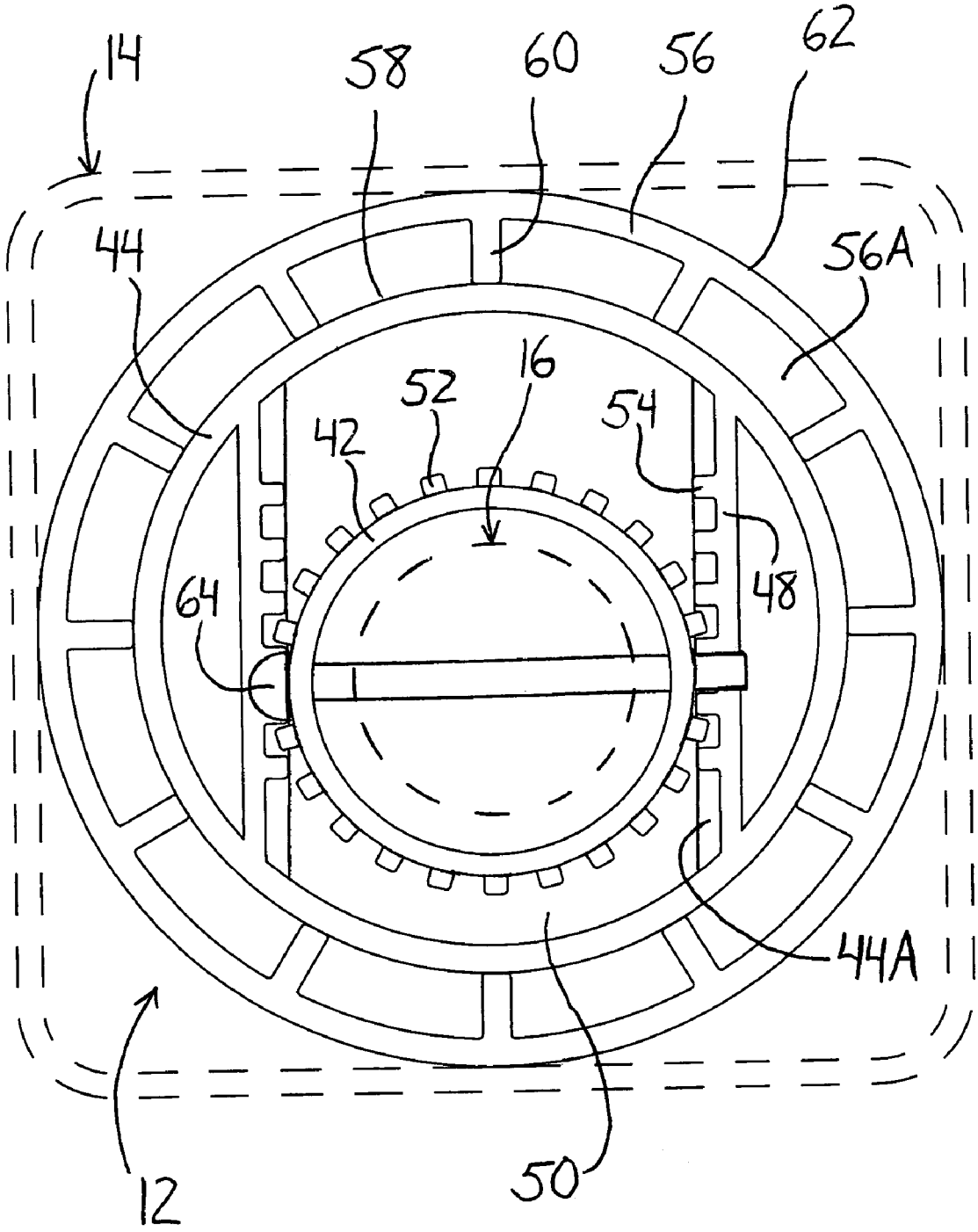
FIG. 7 is a bottom plan view of the upper mounting device of FIG. 1 with the rings of the upper mounting device in the second engaged state of FIG. 6.
Figure 8:
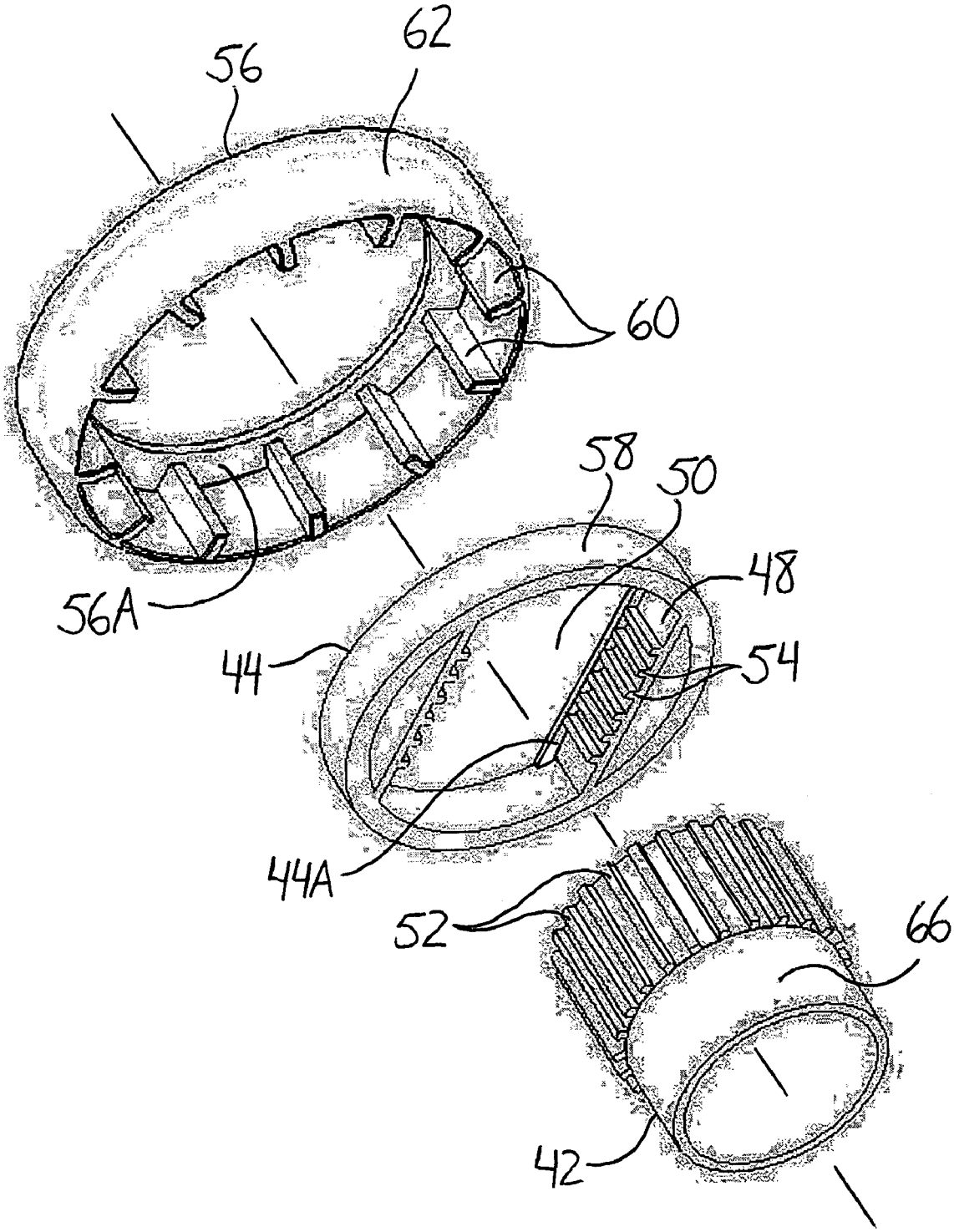
FIG. 8 is a perspective view of the upper mounting device of FIG. 1 with the rings of the upper mounting device in an unengaged state.

When the first ring 42 has been removed from inside the second ring 44 to an unengaged state, as shown in FIG. 8, the rings can be displaced relative to one another along the chord elements 48 so as to offset their axes. In the illustrated embodiment, five spaces between teeth 54 on each of the chord elements 48 correspond to five engaged states of the rings 40, 42, each state having a different respective position of the first ring 42 relative to the second ring 44. For example, the rings 40, 42 can be pulled out of the concentric engaged state shown in FIGS. 4 and 5, shifted relative to one another along the chord elements 48, and re-engaged into one of four eccentric engaged states as provided by the tooth spacing on the chord elements 48. FIGS. 6 and 7 show the rings 40, 42 in one of the engaged states in which the axis of the hollow post 14 is offset from that of the pipe 16 at the upper mounting device 12 due to eccentric positioning of the first ring 40 relative to the second ring 42.

The second and outermost rings 44, 56 of the upper mounting device 12 correspond to the inner and outer annular walls 34, 30 respectively of the lower mounting device 10, in that their outer diameters are sized to frictionally fit different sizes of hollow posts. As an example, when using the inner annular wall 34 of the lower mounting device 10 with a 4-inch square hollow post, the outermost ring 56 of the upper mounting device is removed from the second ring 44, which is then used to frictionally engaged the interior surfaces of the 4-inch square hollow post.

The second and outermost rings 44, 56 feature respective flanges 44A and 56A which support them in a stacked arrangement atop the first ring 42 when in one of the engaged states. Each flange 44A of the second ring 44 disposed along a respective one of the chord elements 48 above the teeth 54 thereon and extends into the opening 50 with the teeth 54. The result is that when the teeth 52 of the first ring 42 are disposed between the teeth 54 of the second ring in any of the engaged states, the flanges 44A sit atop the teeth 52 of the first ring 42 to support the second ring 44 thereon. The flange 56A of the outermost ring 56 extends radially inward along the circumference thereof a distance greater than the ribs 60. The flange 56A therefore rests atop the second ring 44 to support the outermost ring 56 thereon when the second ring is nested within the outermost ring. This reinforces the frictional fitting between the ribs 60 of the outermost ring 56 and the second ring 44 to ensure that the outermost ring 56 cannot be forced downward past the second ring 44.

With the lower mounting device 10 already disposed about and fastened to the pipe 16 at the desired height, the first ring 42 of the upper mounting device 12 is similarly slipped over the pole and fastened thereto, for example by a screw 64. As shown in the Figures, the screw 64 is passed through an untoothed portion 66 of the first ring 42 disposed below the teeth 52 thereof. This untoothed portion 66 extends downward from the second ring 44 when the first ring 42 is partially nested therein in any of the engaged states. Passing the screw 64 through the untoothed portion 66 thereby ensures that the screw will not interfere with engagement of the rings 42, 44 as provided by their teeth 52, 54. With the first ring fastened to the pipe, the second ring 44 is slipped over the first ring 42 into one of the engaged states with or without the outermost ring 56, depending on the size of hollow post being installed on the pipe 16. A level is then oriented to extend upward from one of the annular walls 30, 34 of the lower mounting device to the respective one of the second and outermost rings 44, 56 of the upper mounting device along where a wall of the hollow post would extend if installed to check if they lie in the same vertical plane. If they do not, then the second ring 44 is pulled upward off the first ring 42 to the unengaged state, shifted in a corrective direction as indicated by the level and lowered back onto the first ring 42 in a different engaged state. The level is then shifted ninety degrees to check alignment another vertical plane perpendicular to the first and a similar corrective step is taken through adjustment between the rings of the upper mounting device if needed. It should be appreciated that relative rotation of the first and second rings 40, 42 of the upper mounting device 12 in the unengaged state will change the direction along which their axes are movable relative to each other, thereby allowing adjustment to compensate for lack of alignment to each of these perpendicular vertical planes. Once the upper mounting device has been adjusted to obtain verticality in each of the two perpendicular vertical planes, the hollow post 14 is lowered over the pipe 16 and upper mounting device 12 to engage the lower mounting device 10 and sit atop the base plate 18 thereof.

Having the upper mounting device 12 made of two disengagable components and having only one of them fastened to the pipe 16 facilitates simple adjustment of the hollow post 14 at a later date. For example, ground shifting may move the pipe 16 and cause the hollow post to become off plumb. Upper mounting devices of the prior art would, in such a case, likely require substantial removal of the hollow post from the pipe in order to allow access for adjustments. With the upper mounting device 12 of the detailed embodiment, the hollow post 14 only needs to be lifted enough to disengage the first and second rings 42, 44. The second ring 44, either directly or through the outermost ring depending on the size of post used, is frictionally engaged to the hollow post 14 after initial installation thereof. As a result, lifting of the hollow post 14 mere inches will disengage the first and second rings 42, 44 and allow relative shifting therebetween to realign the hollow post with vertical, at which point the post 14 can simply be lowered back onto the base plate 18 of the lower mounting device 10 to reestablish nesting of the first and second rings of the upper mounting device in a different engaged state. It should be appreciated that this adjustment requires significantly less effort than removing the hollow post entirely from the pipe, unfastening the upper mounting device from the pipe, adjusting the position of the upper mounting device relative to the pipe, refastening the upper mounting device and reinstalling the hollow post over the pipe.

The illustrated embodiment allows fast and easy installation and adjustment of a plastic or vinyl rail structure, such as a fence. Lower mounting devices 10 are spaced apart along a straight line according to the length of rails that will eventually connect the posts and anchored to the ground by their spikes 38. Pipes 16 are then driven into the ground through the pipe-receiving openings of the lower mounting devices. Based on fluctuations in ground level over which the fence will eventually extend, a suitable height for a horizontal base level is chosen. A straight line or level is used to adjust the lower mounting devices of neighbouring posts such that their base plates 18 are supported at this level, and their pipe collars are fastened to the pipe. The elevation of the posts to be mounted will be equal along the length of fence, resulting in a visually pleasing horizontal fence. Before the posts are installed however, the first rings 40 of upper mounting devices 12 are fastened on the pipes 16 at a distance upward from the lower mounting devices, near where the top of the posts will eventually be disposed and the second rings 42 are lowered onto the fastened first rings 40. A level is used to establish vertical lines upward from an outer surface of an annular wall of the lower mounting device and the upper mounting device is adjusted such that an outer surface of its corresponding ring is substantially flush with said lines. The hollow post 14 is then lowered over the pipe 16 and upper mounting device 12 and engaged to the lower mounting device 10. Further adjustment of relative positioning between a post and the respective pipe can be achieved by simply lifting the post 14 upward to disengage the first and second rings 40, 42 of the upper mounting device 12, shifting the post and second ring relative to the pipe and first ring and lowering the post back onto the base plate 18 to engage the first and second rings in a different relative position.

The illustrated embodiment allows quick and easy construction of, for example, a fence that extends horizontally over its entire length by allowing sliding height adjustment of the base on which each post is supported and mounting of the base with a conventional fastener, such as a screw. Further adjustment of the posts toward a vertical orientation after construction is simple due to the lack of need for access to the upper mounting device for adjustments thereof. Each of the mounting devices are fastened to the pipe within the hollow post and do not use any fasteners passed through the hollow post, thereby providing a post assembly having a clean, unblemished appearance.

In an alternate embodiment of the present invention, the lower mounting device has a similar structure to the upper mounting device as described above, but with the addition of a base plate to the bottom of the first ring. Here the first ring forms part of the pipe collar slidable along the pipe to a predetermined height for fastening thereto so as to define the height of the base plate on which the post can be seated. With the first ring so fastened, it can be engaged with the second ring in one of the plurality of engaged positions relative thereto corresponding to a desired position of the hollow post about the pipe near the bottom end of the hollow post. This allows quick and easy adjustment of both the height of the base on which the post rests and the position of the axis of the post relative that of the pipe near the base.

It should be appreciated that the mounting devices of the present invention may be modified for use with pipes and hollow posts of different shapes and sizes. Furthermore, the devices may be used on pipes that are anchored to the ground by means known to those of skill in the art than direct engagement with the earth. The upper mounting device 12 may be used with lower mounting devices other than that of the present invention, just as the lower mounting device 10 may be used with upper mounting devices other than that of the present invention. It should be appreciated that engagable members other than nestable rings may be used to provide the adjustability of the upper mounting device.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A system for mounting a post about a pipe, the system comprising:

a support pipe arranged for connection to a ground surface to extend upward away therefrom;

a hollow post arranged for fitting over the support pipe to extend thereabout;

a lower mounting device arranged for positioning the hollow post about the support pipe; and an upper mounting device for positioning the hollow post about the support pipe at a distance upward along the support pipe from the lower mounting device with the support pipe connected to the ground surface to extend upward away therefrom, the upper mounting device comprising:

a first member adapted to engage an exterior of the support pipe; and a second member adapted to engage an interior of the hollow post;

the first and second members being movable relative to one another between an unengaged state and any of a plurality of engaged states;

in each of the engaged states, the first and second members interlock to secure the first member in a different respective position relative to the second member in a plane perpendicular to the support pipe while allowing withdrawal of the first and second members from engagement by axial movement relative to one another along the support pipe;

wherein one member of the first and second members having projections extending therefrom and the other member having receiving spaces defined between features formed thereon such that the projections of the one member are cooperatively received in any set of the receiving spaces of the other member, each set of receiving spaces corresponding to a respective engaged state of the first and second members.

2. The system according to claim 1 wherein the second member of the upper mounting device is supported on the first member thereof in each of the engaged states and liftable therefrom along the support pipe into the unengaged state.

3. The system according to claim 1 wherein the positions of the first member of the upper mounting device relative to the second member thereof in the engaged states are linearly disposed along the plane perpendicular to the support pipe.

4. The system according to claim 1 wherein the second member of the upper mounting device comprises an opening being greater in size than an outer dimension of the first member and the first member is received at least partly within the opening of the second member in each of the engaged states.

5. The system according to claim 4 wherein the projections comprise teeth extending outward from first member of the upper mounting device toward the second member and the second member comprises teeth extending into the opening thereof toward the first member, the receiving spaces extending into the second member between the teeth thereof and the teeth of the first member engaging with the teeth of the second member with the first and second members in the engaged state.

6. The system according to claim 1 wherein the upper mounting device further comprises a third member engagable to the second member, the third member being adapted to engage an interior of a larger hollow post of greater inner dimension.

7. The system according to claim 6 wherein the third member of the upper mounting device is engagable to the second member to be movable therewith between the engaged state and any of the unengaged states.

8. The system according to claim 1 wherein the multiple sets of receiving spaces are linearly spaced apart from one another to define the positions of the first member of the upper mounting device relative to the second member thereof in the engaged states as being linearly disposed along the plane perpendicular to the support pipe with the first member engaged thereto.

* * * * *